US007137600B2

(12) United States Patent
Lenz

(10) Patent No.: US 7,137,600 B2
(45) Date of Patent: Nov. 21, 2006

(54) METHOD AND APPARATUS FOR AUTOMATIC TRAIN CONTROL IN A DIGITALLY CONTROLLED MODEL RAILROAD SYSTEM

(75) Inventor: Bernd Lenz, Glessen (DE)

(73) Assignee: Lenz Elektronik GmbH, Giessen (DE)

( * ) Notice: Subject to any disclaimer, the term of this patent is extended or adjusted under 35 U.S.C. 154(b) by 174 days.

(21) Appl. No.: 10/988,727

(22) Filed: Nov. 15, 2004

(65) Prior Publication Data

US 2005/0103946 A1 May 19, 2005

(30) Foreign Application Priority Data

Nov. 18, 2003 (DE) ..... 103 53 905

(51) Int. Cl.
*B61L 25/00* (2006.01)

(52) U.S. Cl. ..... 246/115; 246/1 C; 246/122 A; 246/473 A; 246/117; 701/19

(58) Field of Classification Search ..... 246/1 C, 246/473.1, 115, 117, 122 A, 122 R, 167 R, 246/182 R, 187 A, 473 A; 701/19, 20; 340/693.1, 340/693.3, 693.4
See application file for complete search history.

(56) References Cited

U.S. PATENT DOCUMENTS

| | | | | |
|---|---|---|---|---|
| 2,990,964 A | 7/1961 | Timmer | | |
| 4,027,840 A | 6/1977 | Blair | | |
| 4,151,969 A | 5/1979 | Wood | | |
| 5,867,475 A | 2/1999 | Moriya et al. | | |
| 5,896,017 A | 4/1999 | Severson et al. | | |
| 6,140,791 A | 10/2000 | Zhang | | |
| 6,220,552 B1 | 4/2001 | Ireland | | |
| 6,494,410 B1 | 12/2002 | Lenz | | |
| 6,539,292 B1 | 3/2003 | Ames, Jr. | | |
| 6,729,584 B1 * | 5/2004 | Ireland | 246/122 A | |
| 6,853,312 B1 * | 2/2005 | Lenz | 340/904 | |
| 7,028,955 B1 * | 4/2006 | Young et al. | 246/122 A | |
| 2001/0020430 A1 * | 9/2001 | Lenz | 105/1.5 | |

FOREIGN PATENT DOCUMENTS

| | | |
|---|---|---|
| DE | 30 25 035 A1 | 1/1982 |
| DE | 101 03 202 A1 | 9/2002 |

* cited by examiner

*Primary Examiner*—Mark T. Le
(74) *Attorney, Agent, or Firm*—Quarles & Brady LLP

(57) ABSTRACT

A method for automatic train control in a digitally controlled model railroad system includes detecting a polarity change of a track voltage applied to the track by means of a digitally controlled motor vehicle running on the track. The track voltage being a modulated control voltage which is normally symmetric and asymmetric in galvanically isolated track sections. After each detection of a change of polarity, the voltage level of the control voltage applied to the track is sampled independently for each rail of the track by means of the digitally controlled motor vehicle running on the track. The voltage values sampled for each rail of the track are compared to each other and evaluated with regard to any asymmetry occurring in the amplitude of the track voltage with reference to each rail of the track. Depending on the result of the evaluation, the travel operation of the motor vehicle is influenced that is otherwise controlled by the digital control system.

19 Claims, 4 Drawing Sheets

METHOD AND APPARATUS FOR AUTOMATIC TRAIN CONTROL IN A DIGITALLY CONTROLLED MODEL RAILROAD SYSTEM

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

This invention relates to a method and an apparatus for automatic train control in a digitally controlled model railroad system. In contrast to conventionally controlled or analog operated model railroads, in digitally controlled systems each locomotive or motor vehicle has its own individual address. In digitally controlled systems, too, it is possible for a locomotive to stop automatically in front of a railway signal that is showing "Stop". For this purpose, the operating voltage is turned off in a stop section that is galvanically isolated from the rest of the track. However, the locomotive can then no longer be controlled by the digital control system, because it can no longer receive its control information.

To solve this problem, special strings of digits were inserted into the digital signal for such a stop section, for example, strings of digits that can be detected and analyzed by each locomotive that is equipped with digital receivers. However, necessary provisions on the track site to enable insertion of such particular digits ahead of each signal are quite extensive and therefore result in high costs.

Another and significantly simpler method is to make the digital signal asymmetric for such a stop section and to evaluate this asymmetry information in the locomotive decoder. Normally, the digital signal in almost all digital systems consists of an AC voltage having negative and positive components of equal amplitude, i.e. one that is symmetric. The advantage of an apparatus that utilizes this method of asymmetry in the digital information consists of its simplicity. On the track site, all that is needed are a few rectifier diodes, and on the decoder site trivial comparator circuits.

Whereas the asymmetric system described above has a very simple construction, it exhibits the following disadvantages. The large-scale industrial trains recognize, in addition to a stop at a signal, two additional conditions that are not implemented in the conventional asymmetric system described above. The first of these conditions is that the stop signal does not apply to a train that is approaching the railway signal from its back side. The second is that in addition to the "stop" information, there is also a "restricted speed" information. Nor can this method be used if the digital system has the capability of simultaneously operating a conventional (analog) locomotive. That is because the track voltage is generally transmitted to the comparator of a locomotive detector via an RC circuit. Because of the different pulse lengths that are inherent to conventional or analog operation (see DE 30 25 035), the locomotive decoder would already detect an asymmetry for this reason.

BRIEF SUMMARY OF THE INVENTION

It is an object of the invention to provide a method and an apparatus for automatic train control in digital model railroad systems that maintain the simplicity of the above-mentioned automatic train control using amplitude asymmetry in a square-wave track voltage, but reliably recognize any asymmetry that is present, regardless of the pulse duty factor of the square-wave track voltage.

The invention teaches that an instantaneous voltage level of the track voltage supplied to the track is always measured after an occurrence of a polarity change, which is detected in any case in the decoder of a digitally controlled motor vehicle such as a locomotive. The detected level is directly evaluated in the decoder of the motor vehicle with regard to any asymmetry in terms of the level or amplitude of the sampled voltage. The instantaneous sampling of the voltage level means that the length of the respective positive or negative voltage level is not included in the measurement, as would be the case with an upstream RC circuit. It is therefore also possible to control a conventional locomotive or direct current locomotive at the same time as digitally controlled locomotives without the need for complex and expensive additional means to implement both alternatives.

One major advantage of the invention results from the fact that the track voltage is independently measured for the two sides or rails of the track. For this reason, the running behavior of the motor vehicle or train can be controlled by making use of a voltage asymmetry identified as resulting from one side or rail of the track or the other. Thus it is possible for a digitally controlled motor vehicle to recognize whether the voltage level on the right side of the vehicle or on the left side of the vehicle is higher (or conversely lower). Therefore a train, as it approaches a railway signal set to "Stop" from the front of the signal can be braked to a complete stop, while it can keep running if it approaches the railway signal set to "Stop" from the back side of the signal.

In an embodiment of the invention that offers significant advantages, the running behavior or operation of the motor vehicle or train can be controlled, by taking into account also the direction of travel set by the digital control. Thus a train, regardless of whether it is traveling forward or in reverse, can be braked to a stop when it approaches a railway signal set to "Stop" from the front of the signal, while it can keep running when it approaches the railway signal set to "Stop" from the back side of the signal. Moreover, for example, a train that approached a railway signal set to "Stop" from the front side of the signal and was then braked to a stop in the stop section can be moved away from the railway signal set to "Stop" by reversing the direction of travel using the digital control system.

In a further embodiment that exhibits significant advantages, the amplitude of every positive (or conversely negative) level of the asymmetric operation voltage applied to influence the train is not modified. Instead, the amplitudes of positive (or conversely negative) levels of the track voltage are modified with varying frequencies. For example, the amplitude of each nth positive (or negative) level of the asymmetric operating voltage can be varied, wherein n is an integer that is equal to or greater than 2. Alternatively for example, two or three levels can be varied that are separated from one another by one or more sequential unchanged levels. This results in a kind of de facto modulation of the asymmetry. This further development allows, for example, to transmit information for controlling the train to travel at a restricted speed, a situation that might be necessary when the train is running over switches. Any intermediate speed step that is available can ultimately be used for the restricted-speed travel.

The features explained above each represent an independent aspect of the invention, considered individually or in any desired combination. These features are: measuring the voltage level at the right and left rail of the track corresponding to the right and left sides of the motor vehicle, respectively, independently of each other and evaluating the levels for any possible asymmetry; and, in addition, taking into consideration the currently set direction of travel into a decision regarding the kind of train control; as well as modulating the asymmetric voltage level.

These features or characteristics and their further developments are not limited to a frequency-modulated and/or pulse length modulated square-wave operating voltage. Instead, they can be used with AC operating voltages having any wave form, for example with sine-wave operating voltages. A peak-value rectifier may be necessary to measure the respective maximum voltage level.

Thus the general principle on which the invention is based, of increasing the simplicity of the automatic train control system by the above-mentioned asymmetry, can easily be extended so as to include a directionally dependent automatic train control, to include a restricted speed command, while still preserving the capability of controlling a conventional direct current locomotive at the same time.

In an advantageous further development of the invention, the invention teaches that the evaluation result is determined by majority decision from a specified number of sequential comparison results. The invention also teaches that the track voltage can be measured so briefly or shortly after a polarity change that the measurement or sampling is completed before the next polarity change occurs. For this purpose the measurement is performed only during a half wave, alternately for one side or rail of the track or the other, and is triggered by a polarity change, so that level variations of the square-wave voltage from period to period can be recorded.

The invention also relates to a locomotive decoder which is configured according to the invention and/or operates according to the method taught by the invention.

BRIEF DESCRIPTION OF THE DRAWINGS

A preferred exemplary embodiment of the invention is explained below with reference to the accompanying drawings, in which.

DETAILED DESCRIPTION OF THE PREFERRED EMBODIMENTS

Figure 1:
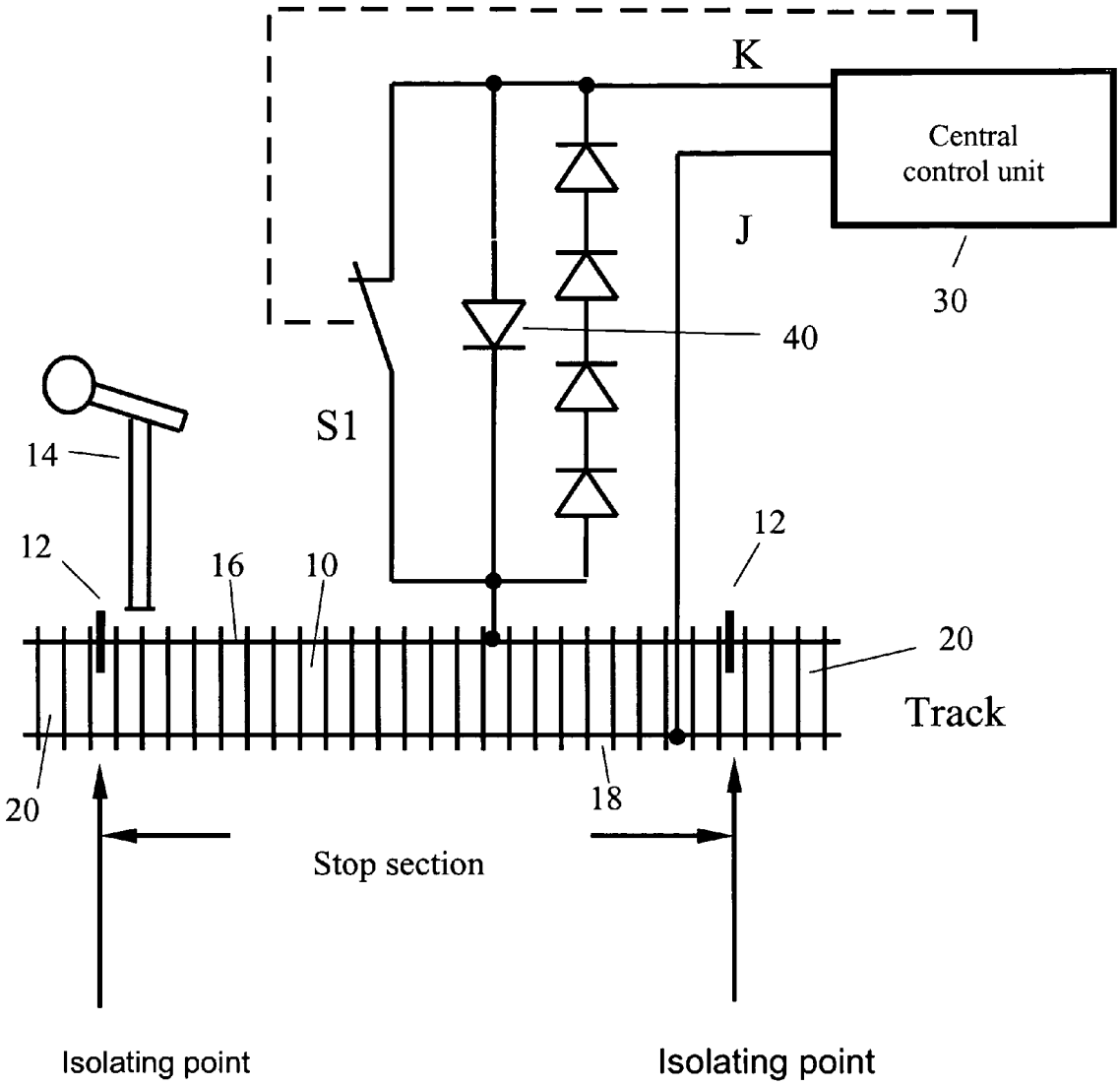
FIG. 1 is a schematic illustration of a section of track of a model railroad system with a stop section and a device for asymmetric variation of the voltage level of a travel operation voltage generated by a control device.

As shown in FIG. 1, a stop section 10 is galvanically isolated by means of isolating points 12 from the rest of the track 20. On the left end of the stop section 10, there is a railway signal 14. A digital central control unit 30 provides a square-wave operating voltage or, in short, control voltage U at its outputs K and J, in conventional manner. The control voltage U supplies the motor vehicles located on the track not only with traveling or driving power but also with travel control information (speed and direction) in conventional manner. For the latter purpose, the control voltage U is frequency-modulated and/or pulse length modulated as a function of digital control information. The digital data transmission can be realized, for example, using the NMRA DC Electrical Standard and the NMRA DCC Communication Standard.

As illustrated in FIG. 1, the output K of the central control unit 30 is connected via a level-changing device 40 with the "upper" rail or track side 16 of the stop section 10. The output J of the control unit 30 is directly connected with the "lower" rail or track side 18 of stop section 10. Although not shown in FIG. 1, the outputs K and J of control unit 30 are directly connected in conventional manner to the upper and/or lower track side of the rest of the track 20.

Figure 2A:
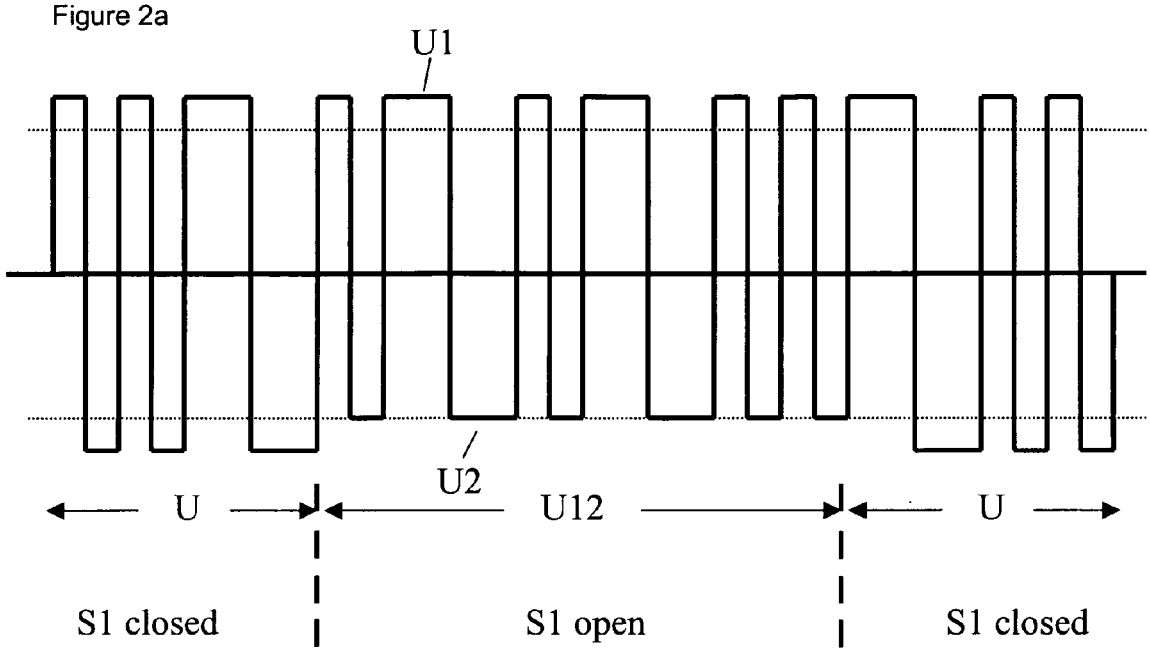
FIG. 2*a* illustrates an example of a travel operation voltage applied to the stop section illustrated in FIG. 1, in which the negative level of the asymmetric voltage is reduced in comparison to the symmetric voltage.
Figure 2B:
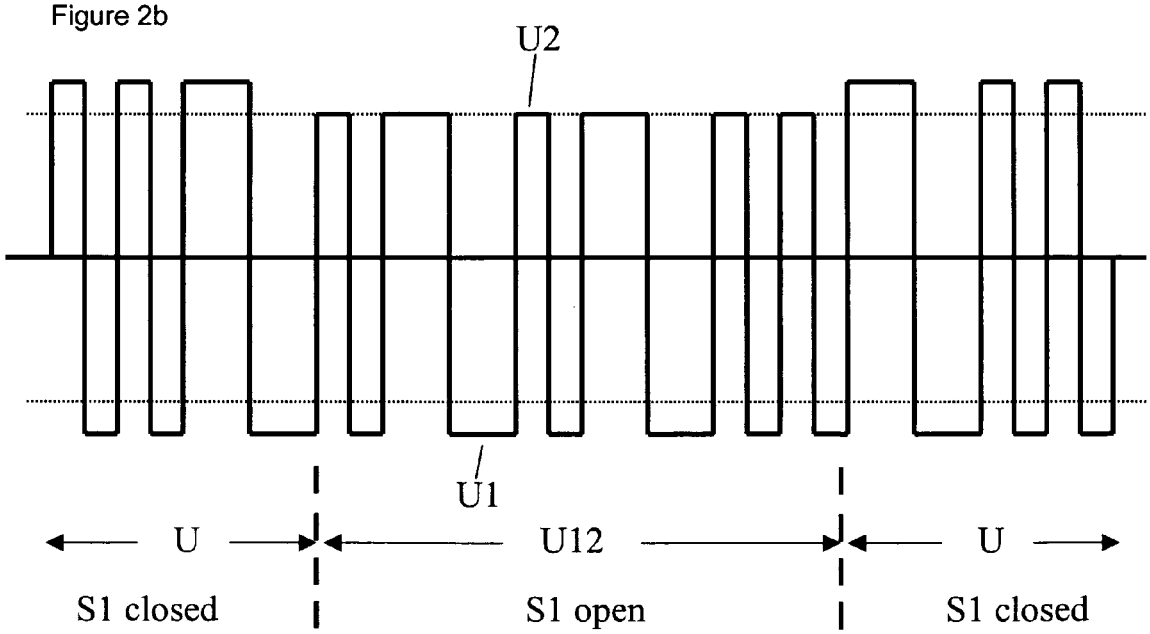
FIG. 2*b* shows the example illustrated in FIG. 2*a*, but with the positive levels of the asymmetric voltage reduced.
Figure 3:
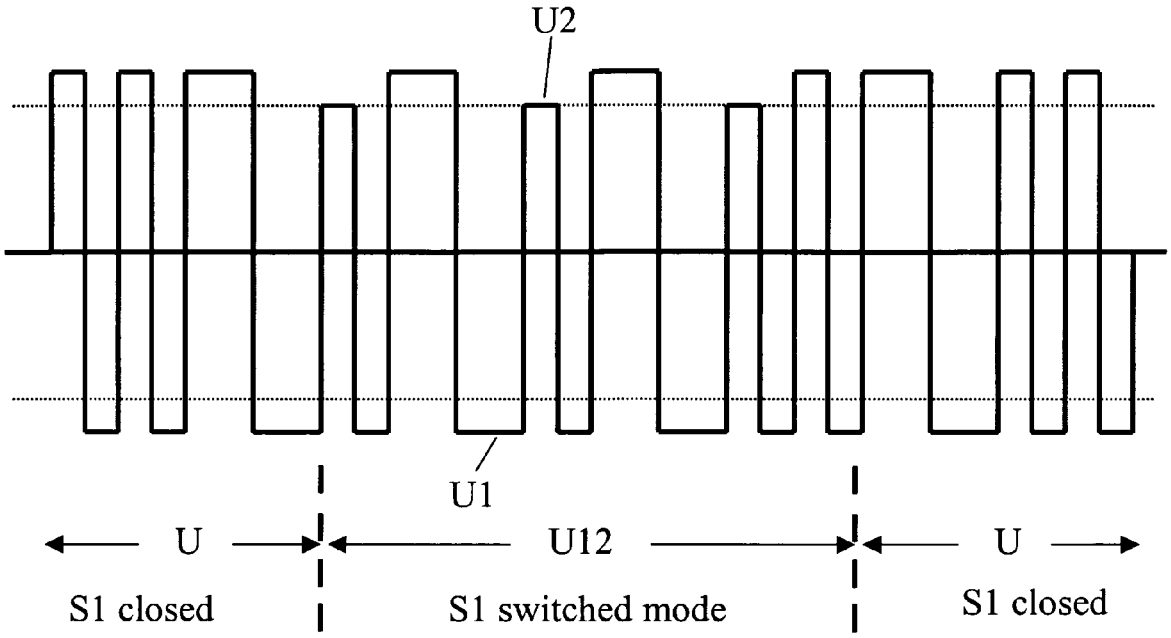
FIG. 3 shows an additional example of a travel operation voltage applied to the stop section in FIG. 1, in which each second positive level of the asymmetric voltage is reduced.

The control voltage U that is applied between the outputs K and J is illustrated on the right-hand side and left-hand side in FIGS. 2*a* and 2*b* as well as in FIG. 3. As shown in the Figures, voltage U is a voltage having a symmetric amplitude. The level-changing device 40 is able to transform the symmetric control voltage U into a modified control voltage U12 with an asymmetric amplitude and to apply, as desired, the asymmetric control voltage U12 instead of the symmetric control voltage U to stop section 10. Examples of the modified control voltage U12 with asymmetric amplitude are shown in the mid-portions of FIGS. 2*a* and 2*b* as well as in FIG. 3. Apart from the asymmetric amplitude variation, the control voltage U12 is otherwise identical to control voltage U.

As shown in FIG. 1, the level changing device 40 can be very easily implemented by means of an inverse-parallel connection consisting of a few rectifier diodes and a controllable switch S1 that is connected in parallel to the diode circuit. In the illustrated example, the switch S1 is controlled by control unit 30. It can also be controlled by the railway signal, for example.

If the railway signal 14 provided on the left end of the stop section 10 is set to "Go", the control unit moves the switch S1 into the closed position, so that the symmetric control voltage U is applied to the stop section 10 as well as to the rest of the track 20. A train that enters the stop section 10 or is already there is therefore operated exclusively in accordance with the traveling data that have been individually set by means of the digital control, and its traveling behavior is otherwise not influenced.

On the other hand, if the railway signal is set to "Stop", the control unit controls the switch S1 into the open position, so that the asymmetric travel control voltage U12 is applied to the stop section 10, in contrast to the rest of the track 12 which receives the symmetric voltage. A train that enters the stop section 10 or is already there detects the asymmetrically modified control voltage U12, which is different from the symmetric operating voltage or control voltage U. Therefore, the train influences its running or traveling behavior in a manner which differs from the traveling data that are individually set by the digital control system.

FIG. 2*a* shows one example of the voltage applied to the stop section 10 with the switch S1 open and closed. As shown in the drawing, when switch S1 is open, the rectifier diode circuit of the level-changing device 40 reduces the negative voltage level due to the voltage drops that add up in a plurality of diodes connected in series, while the positive voltage level suffers a barely perceptible drop generated by one diode only, i.e. it remains practically unchanged.

FIG. 2*b* shows, like FIG. 2*a*, a voltage applied to the stop section 10. Here, the positive voltage level is reduced with switch S1 being open. To achieve this, all the diodes in the rectifier diode circuit illustrated in FIG. 1 have to be connected with opposite polarity.

Figure 4A:
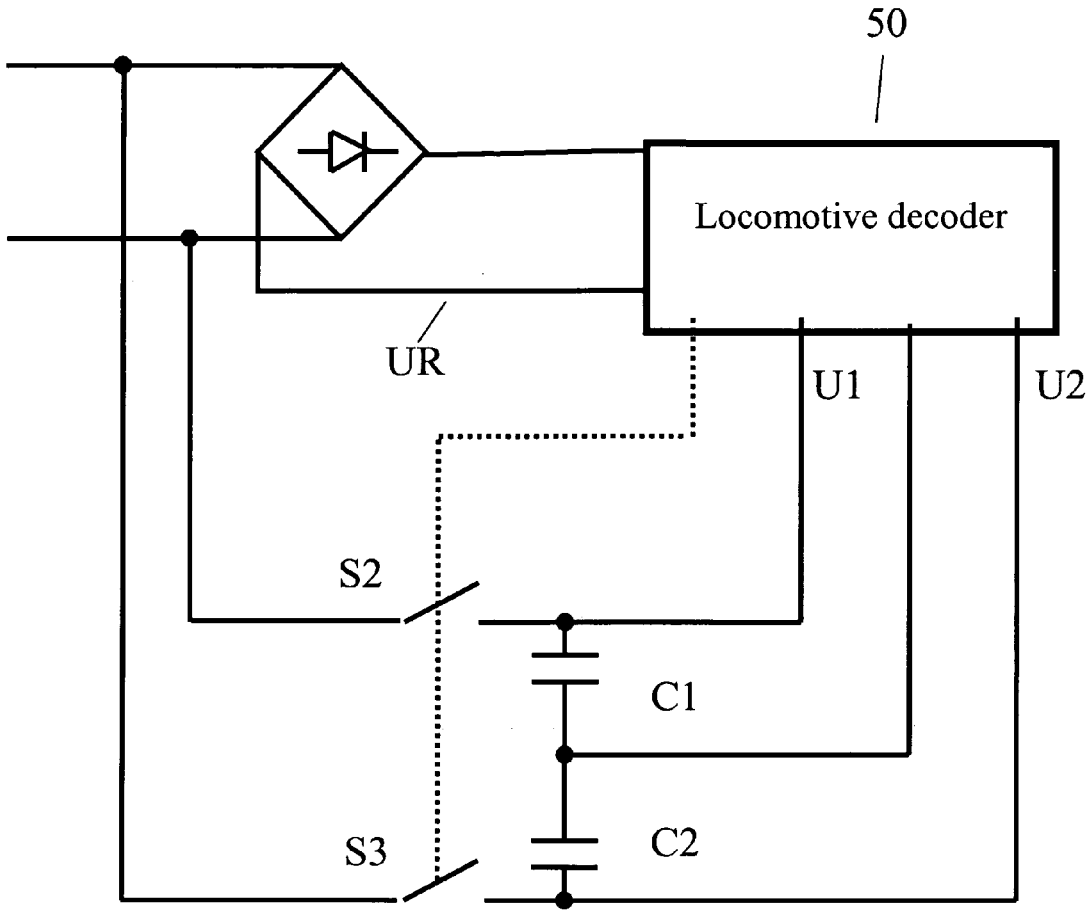
FIG. 4*a* is a schematic illustration of circuitry realized in a digital receiver of a motor vehicle or train of a model railroad system.

A digital receiver schematically illustrated in FIG. 4*a* in a motor vehicle or train that is running on the track of the model railroad system performs, in conventional manner, a full-wave rectification of the track voltage taken from the track. The direct voltage obtained is used, likewise in conventional manner, to supply energy to a decoder 50, to a digitally controlled traction motor etc. The manner of digitally controlling the driving motor is well-known and is therefore not illustrated in FIG. 4*a*.

Figure 4B:
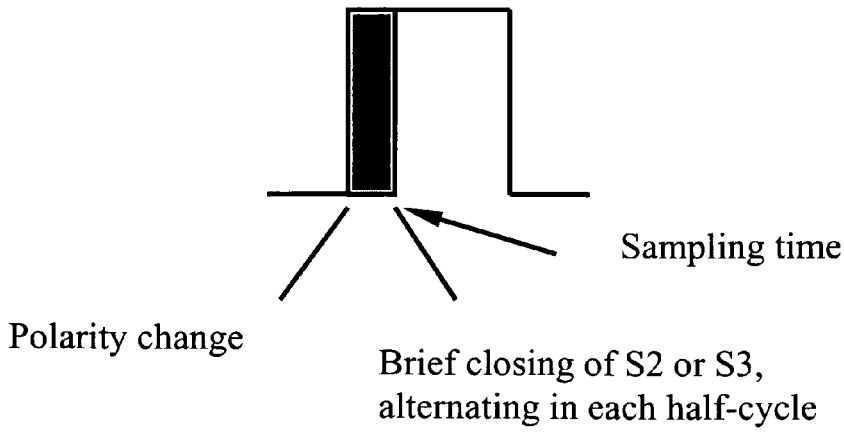
FIG. 4*b* is a schematic illustration of a section of a track voltage tapped from the track after a polarity change.

On the other hand, FIG. 4*a* does show, and specifically when considered together with FIG. 4*b*, the construction and operation of an exemplary embodiment in accordance with the present invention. This embodiment is characterized by a circuit which instantaneously samples the voltage applied to the track after a polarity change and which supplies the sampled voltage values to a comparator that is integrated in the decoder 50. In this context, it should be noted that the occurrence of a polarity change is detected in the decoder anyway. Therefore this function is already available in a digitally controlled motor vehicle or train.

The illustrated sampling circuit having two switches S2 and S3 that can be controlled by the decoder 50 and two capacitors C1 and C2 is designed so that the voltages for the left and right rails of the track are measured independently of each other. As shown in FIG. 4*b*, the switches S2 and S3 associated with the respective sides or rails 16, 18 of the track are closed immediately after the occurrence of a polarity change in the square-wave track voltage. The two switches are thereby closed alternately, each during a half-cycle. The voltage levels U1 and U2 thereby measured or sampled instantaneously for each rail of the track are compared in the decoder to the decoder ground or reference potential UR. For this reason, the capacitors C1 and C2 are connected at one side to the decoder reference potential UR. The decoder reference potential UR is derived from the negative pole of a bridge-type rectifier shown in FIG. 4*a* and represents the most negative voltage level behind the bridge-type rectifier.

The voltage levels U1 and U2 referenced to the decoder reference potential or ground, i.e. the voltages that occur at the respective sampling times at capacitors C1 and C2, are compared to each other in the comparator. Depending on whether U1 is larger or smaller than U2, the comparator provides a binary 0 or 1 at its output. It can thereby be determined on which of the two track rails or sides 16, 18 the asymmetrically modified voltage amplitude is occurring. For this purpose, a voltage value measured for one track rail in a half-cycle or half-period of the square-wave voltage is compared with a voltage value measured for the other track rail or side in the next half-cycle.

At this point it should be mentioned that the two switches S2 and S3 as well as the two capacitors C1 and C2 need not necessarily be physically present, and are included in the illustration in FIG. 4*a* essentially only to explain a sampling and stopping function which functions can also be performed by the locomotive decoder.

The comparator incorporated in the decoder 50 but not shown in FIG. 4*a* then determines after every polarity change not only whether there is any voltage level asymmetry at all, but also on which side or rail of the track the asymmetry occurs. This feature results in a high degree of flexibility in automatic train control, when the current direction of travel set by the digital control in a motor vehicle or train is also taken into consideration. This situation is explained in greater detail below with reference to FIG. 1.

For purposes of this explanation, it is assumed that a railway vehicle, for example a motor vehicle or a train, like a non-railway vehicle, such as an automobile for example, has, regardless of whether it is traveling forward or in reverse direction or is standing still, a right and a left vehicle side or right and left wheels.

If a train traveling forward from the right reaches the stop section 10, it will detect a change in the voltage level, in the present example a reduced level, on its right side when the signal 14 is set to "Stop". As a result of this detection, the train is braked ahead of the signal 14 by a program stored in the decoder 50 until it comes to a stop.

If a train traveling forward from the left reaches the stop section 10, it will detect a reduced voltage level on its left side when the signal 14 is left to "Stop". As a result of this detection, the train will keep running through the stop section 10 unbraked, according to a program stored in the decoder 50, or will optionally run through the stop section 10 after it has been braked down to a lower speed.

If a train traveling in reverse from the right reaches the stop section 10, it will detect on its left side, in accordance with the above definition, a reduced level when the signal 14 is set to "Stop". As a result of this detection and the reverse command set in the train or in the decoder 50, the train is braked to a stop in front of the signal 14 by the program stored in the decoder 50.

If a train traveling in reverse from the left reaches the stop section 10, it will detect on its right side, as defined above, a reduced level when the signal 14 is set to "Stop". As a result of this detection and the reverse setting in the train and in the decoder 50, the train will keep running through the stop section 10 unbraked, according to a program stored in the decoder 50, or it can also run through the stop section 10 at a reduced speed.

In other words, the arrangement described above works even if a locomotive is taken off the track and is put back on the track reversed.

Other train control sections that are galvanically isolated from the rest of the track can also be provided, for example a restricted-speed section. An asymmetrically amplitude-modified control or track voltage can be applied continuously to such a restricted-speed section, for example, or the symmetric control voltage or an asymmetric control voltage can be applied as required. One example for the latter alternative is illustrated in FIG. 3. In this example, in contrast to FIGS. 2*a* and 2*b*, not every level is reduced, but only every second level of the asymmetric voltage. This is accomplished by an appropriate clockwise control of switch S1.

The clocked asymmetric control voltage U12 illustrated in the center portion of FIG. 3 can be recognized by the decoder 50, as explained above, and can also be recognized with regard to one side or rail of the track or the other. Furthermore, the recognized and detected voltage can be used to make a decision relating to the automatic train control influence, specifically making also use of the currently set direction of travel. In this manner, different pre-programmed speed levels can be selected depending on whether a train is traveling backward or forward and whether it is entering a restricted-speed section from the right or left.

At this point, it should be mentioned that the asymmetric traveling voltage signal is a broadcast signal to which all digitally controlled motor vehicles respond regardless of their addresses if they are on the track section to which the asymmetric traveling voltage signal is applied. It should also be mentioned that even while a motor vehicle is on a segment or section of the track that is supplied with the asymmetric control voltage, the motor vehicle can be supplied with individual digital control information via its address, because the asymmetric travel voltage or control signal, apart from the amplitude asymmetry, is otherwise identical to the symmetric amplitude travel voltage or control signal. In other words, the modulation control data can still be used.

In the exemplary embodiment used to explain the invention, the square-wave operating or control voltage U applied between the two sides or rails 16, 18 of the track is approximately 15 Volts and the frequency of this voltage is in a range from approximately 5 to 10 kHz. The amplitude-asymmetric voltage U12 is lowered by approximately 1 to 2 Volts on one of the two sides or rails of the track. The operation of a conventionally or analog controlled locomotive will therefore not be significantly adversely affected. The sampling of the track voltage occurs approximately 5 to 10 μs after the detection of each polarity change.

Those skilled in the art will be able to modify these values without departing from the spirit of the invention as set forward in the following claims.

I claim:

1. A method for automatic train control in a digitally controlled model railroad system, said method comprising:

applying a control voltage to a track of the system, said control voltage being a square-wave operating voltage which is modulated corresponding to control information and has a symmetric amplitude;

generating an asymmetric-amplitude control voltage that is otherwise essentially identical to the symmetric control voltage and applying this asymmetric control voltage to a section of the track that is used for influencing train control and is galvanically isolated from the rest of the track;

detecting a polarity change of the control voltage applied to the track by means of a digitally controlled motor vehicle running on the track;

after each detection of a change of polarity, sampling the voltage level of said control voltage applied to the track independently for one side and the other side of the track by means of said digitally controlled motor vehicle running on the track;

comparing the voltage values sampled for each side of the track to each other;

evaluating the comparison result with regard to any asymmetry occurring in the amplitude of the control voltage with reference to the side of the track; and depending on the result of the evaluation, influencing the travel behavior of the motor vehicle that is otherwise controlled by the digital control system.

2. The method as claimed in claim 1, in which said control voltage corresponding to said control information is at least one of frequency-modulated and pulse length modulated.

3. The method as claimed in claim 1, in which the symmetric control voltage or the asymmetric control voltage is optionally applied to said galvanically isolated track section.

4. The method as claimed in claim 1, in which the evaluation result is determined by a majority decision from a specified number of sequential comparison results.

5. The method as claimed in claim 1, in which the control voltage is measured after a polarity change is detected and the measurement is completed before detection of the next polarity change.

6. The method as claimed in claim 1, in which the travel operation of the motor vehicle is automatically influenced taking into consideration a direction of travel of the motor vehicle as set by the digital control system.

7. The method as claimed in claim 1, in which the amplitude of each positive (or conversely negative) level of the asymmetric control voltage is modified.

8. The method as claimed in claim 1, in which the amplitude of only predetermined ones of the positive (or conversely negative) levels of the asymmetric control voltage are modified.

9. The method as claimed in claim 8, in which the amplitude of each nth positive (or conversely negative) level of the asymmetric control voltage is modified, wherein n is an integer equal to or greater than 2.

10. An apparatus for automatic train control in a digitally controlled model railroad system, said apparatus comprising:

a central control unit for applying a control voltage to a track of the system, said control voltage being a square-wave operating voltage which is modulated corresponding to control information and has a symmetric amplitude;

means for generating an asymmetric-amplitude control voltage that is otherwise essentially identical to the symmetric control voltage and applying this asymmetric control voltage to a section of the track that is used for influencing train control and is galvanically isolated from the rest of the track;

means for detecting a polarity change of a said control voltage applied to the track and being provided in a digitally controlled motor vehicle running on the track;

sampling means for sampling, after each detection of a change of polarity, the voltage level of said control voltage applied to the track independently for one side and the other side of the track, said sampling means being provided by said digitally controlled motor vehicle running on the track;

comparator means for comparing the voltage values sampled for each rail of the track to each other;

evaluation means for evaluating the comparison result with regard to any asymmetry occurring in the amplitude of the control voltage with reference to each rail of the track; and means for influencing, depending on the result of the evaluation, the travel operation of the motor vehicle that is otherwise controlled by the digital control system.

11. The apparatus as claimed in claim 10, in which said means for generating applies one of the symmetric control voltage and the asymmetric control voltage to the galvanically isolated track section.

12. The apparatus as claimed in claim 10, in which the evaluation device determines the result of the evaluation by majority decision from a specified number of sequential comparisons.

13. The apparatus as claimed in claim 10, in which the sampling means samples the control voltage after detection of a polarity change and completes the sampling before the next detected polarity change.

14. The apparatus as claimed in claim 10, in which the influencing means influences the travel operation by taking into consideration the direction of travel of the motor vehicle currently set by the digital control system.

15. The apparatus as claimed in claim 10, in which said means for generating an asymmetric-amplitude control voltage has a level-changing device which modifies the amplitude of each positive (or conversely negative) level of the asymmetric control voltage.

16. The apparatus as claimed in claim 10, in which said means for generating an asymmetric-amplitude control voltage has a level-changing device which modifies the amplitude of only predetermined positive (or conversely negative) levels of the asymmetric control voltage.

17. The apparatus as claimed in claim 16, in which said level-changing device modifies the amplitude of each nth positive (or conversely negative) level of the asymmetric travel operation voltage, wherein n is an integer equal to or greater than 2.

18. The apparatus as claimed in claim 15, in which the level-changing device is a rectifier diode circuit which is connected in parallel to a switch controlled by the central control unit.

19. The apparatus as claimed in claim 16, in which the level-changing device is a rectifier diode circuit which is connected in parallel to a switch controlled by the central control unit.

* * * * *